US008721039B2

(12) United States Patent
Jo

(10) Patent No.: US 8,721,039 B2
(45) Date of Patent: May 13, 2014

(54) IMAGE FORMING APPARATUS

(75) Inventor: Honriku Jo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/435,256

(22) Filed: Mar. 30, 2012

(65) Prior Publication Data

US 2012/0306963 A1 Dec. 6, 2012

(30) Foreign Application Priority Data

Jun. 1, 2011 (JP) ..... 2011-123150

(51) Int. Cl.
*B41J 2/165* (2006.01)

(52) U.S. Cl.
USPC ..... 347/35

(58) Field of Classification Search
USPC ..... 347/35
See application file for complete search history.

(56) References Cited

U.S. PATENT DOCUMENTS

| | | | | |
|---|---|---|---|---|
| 6,082,848 | A * | 7/2000 | Taylor | 347/35 |
| 2007/0247505 | A1* | 10/2007 | Isowa et al. | 347/101 |
| 2008/0174632 | A1* | 7/2008 | Miyamoto et al. | 347/35 |
| 2012/0056932 | A1 | 3/2012 | Matsubara et al. | |

FOREIGN PATENT DOCUMENTS

| | | |
|---|---|---|
| JP | 2000-153621 | 6/2000 |
| JP | 2001-341321 | 12/2001 |

* cited by examiner

*Primary Examiner* — Justin Seo
(74) *Attorney, Agent, or Firm* — Cooper & Dunham LLP

(57) ABSTRACT

The present invention provides an image forming apparatus including: a print head, including nozzle heads, configured to discharge ink droplets upward and movable between an image forming area in which images are formed on a recording medium and an idle discharge area in which idle discharge of the ink droplets is performed to clean the nozzles; an endless belt ink receiving member, disposed above the print head in the idle discharge area in which the print head performs idle discharge and configured to hold the idly-discharged ink; an ink receiving member driver operatively connected to the ink receiving member to circularly drive the ink receiving member; and a cleaner disposed downstream of the idle discharge area in the direction of rotation of the ink receiving member and configured to remove the ink from the ink receiving member.

9 Claims, 9 Drawing Sheets

IMAGE FORMING APPARATUS

CROSS-REFERENCE TO RELATED APPLICATION

The present application claims priority from Japanese patent application number 2011-123150, filed on Jun. 1, 2011, the entire contents of which are incorporated by reference herein.

BACKGROUND OF THE INVENTION

1. Field of the Invention

The present invention relates to an image forming apparatus and, in particular, relates to an image forming apparatus including a print head configured to discharge ink droplets upward from nozzle heads to form an image on a recording medium and to perform idle discharge to clean the nozzle heads.

2. Description of the Related Art

An inkjet recording apparatus employing a print head including nozzles and configured to discharge ink droplets from the nozzles and form an image on a recording medium is one type of widely used image forming apparatus. In such an image forming apparatus, idle discharge of the ink droplets is performed to maintain an optimal ink discharge status. This idle discharge is performed in such a manner that, after the print head is cleaned, ink droplets are discharged from the nozzles of the print head to an area outside the normal printing range either during or after printing. Accordingly, the idle discharge may also be referred to as dummy discharge or blank discharge.

In recent models of inkjet recording apparatuses, in general, several tens of idle discharges are shot at each nozzle every several seconds. Upon completion of the cleaning, the idle discharge is performed to prevent color mixing. Alternatively, the idle discharge is performed at the start of printing or regularly during printing. Several thousands to several tens of thousands of blanks are shot from each nozzle.

The idle-discharge ink is collected and recovered in an idly-discharged-ink collection tank. FIG. 13 is a cross-sectional view illustrating an example of a conventional collection tank for the idle discharge. The idle discharge tank 10 includes a porous sheet member 12 configured to receive ink droplets 13 from a print head 15 and a tank 11 to hold the collected ink. The ink droplets 13 idly-discharged from the print head 15 contact and are absorbed by the sheet member 12. Ink 14 leaking through the sheet member 12 falls and is collected in the tank 11.

Certain image forming apparatuses including a print head are configured to discharge ink droplets upward. Typically, a print head configured to discharge ink upward is adopted for an image forming apparatus capable of simultaneously forming images on both sides of the recording medium. In this type of image forming apparatus, a recording medium is conveyed between one print head configured to discharge ink droplets upward and a second print head configured to discharge ink droplets downward, so that images are formed simultaneously on both sides of the recording medium by the two print heads.

The idle-discharge ink discharged from the print head that discharges the ink droplets downward is collected in the idle discharge tank 10. On the other hand, the idle-discharge ink discharged from the print head that discharges ink droplets upward is collected in an idle discharge tank disposed above the print head. FIG. 14 is a cross-sectional view illustrating an example of a tank for the idle discharge corresponding to the print head that discharges the ink droplets upward as disclosed in JP-2001-341321-A.

The idle discharge tank 20 disclosed in the above publication includes a tank 21 above the print head 26. The tank 21 includes a protruding rib 23 disposed on a periphery of an opening 22 and preventing the upwardly discharged ink droplets from dripping off toward outside. In the idle discharge tank 20, the ink discharged as idle discharge from the print head 26 strikes an upper surface 24 of the tank member 21, flows down along the wall and is reserved in a bottom 25.

Further, there is a type of idle discharge tank that includes a function to prevent generation of mist (or fine ink droplets) from the ink droplets discharged from the print head. FIG. 15 is a cross-sectional view illustrating an example of an idle discharge tank capable of preventing generation of the mist as disclosed in Japanese Patent No. 3707274. This idle discharge tank 30 includes an ink absorbing sheet 33 disposed at an upper wall 32 of a tank member 31. The ink-absorbing sheet 33 absorbs ink droplets discharged from a print head 26 to an opening 34 of the tank member 31, thereby preventing generation of the mist.

However, in the conventional image forming apparatus, the ink droplets and the mist circulate inside the tank member and disperse from the opening due to an air stream generated by the idle-discharge ink droplets inside the tank member. Then, the ink droplets that cannot be held by the ink absorbing sheet disperse and contaminate the print head.

BRIEF SUMMARY OF THE INVENTION

The present invention provides a novel image forming apparatus capable of collecting the idle-discharge ink even when the print head configured to discharge ink droplets upward performs idle discharge of the ink droplets upward, so as to prevent contamination of the print head.

The present invention provides an image forming apparatus including: a print head, including nozzle heads, configured to discharge ink droplets upward and movable between an image forming area in which images are formed on a recording medium and an idle discharge area in which idle discharge of the ink droplets is performed to clean the nozzles; an endless belt ink receiving member, disposed above the print head in the idle discharge area in which the print head performs idle discharge and configured to hold the idly-discharged ink; an ink receiving member driver operatively connected to the ink receiving member to circularly drive the ink receiving member; and a cleaner disposed downstream of the idle discharge area in the direction of rotation of the ink receiving member and configured to remove the ink from the ink receiving member.

According to the present invention, because the idle-discharge ink from the print head is held in the ink receiving member and is removed at a position apart from the print head, the ink does not disperse or fall down on the nozzle head and the nozzle head is prevented from being contaminated.

These and other objects, features, and advantages of the present invention will become more readily apparent upon consideration of the following description of the preferred embodiments of the present invention when taken in conjunction with the accompanying drawings.

BRIEF DESCRIPTION OF THE DRAWINGS

FIGS. 3A-3C each show a general configuration of a print head of the image forming apparatus of FIG. 1, in which FIG. 3A shows a plan view of the print head, FIG. 3B a side view thereof, and FIG. 3C a front view of the same;

FIGS. 5A-5C each show a general configuration of a print head and an ink receiver of an image forming apparatus according to a second embodiment, in which FIG. 5A shows a plan view of the print head and the ink receiver, FIG. 5B a side view thereof, and FIG. 5C a front view of the same;

DETAILED DESCRIPTION OF THE INVENTION

First Embodiment

Figure 1:
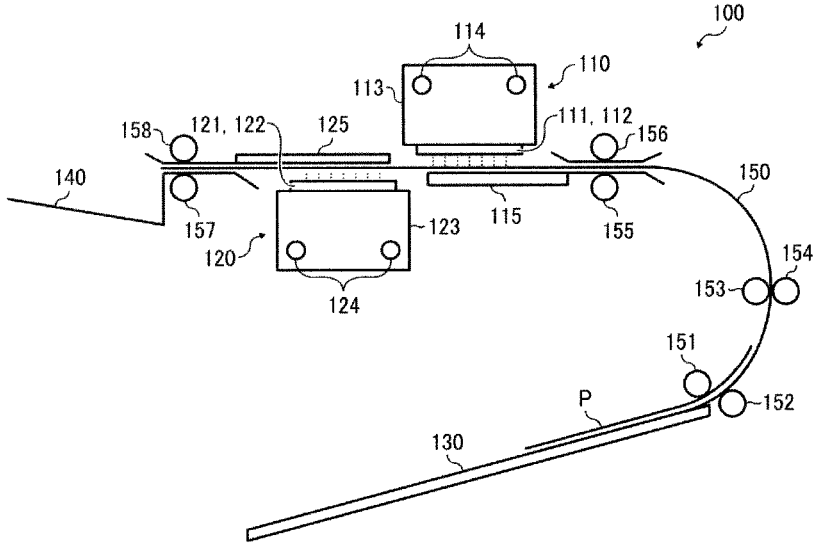
FIG. 1 is a general configuration of an image forming apparatus according to a first embodiment of the present invention.
Figure 2:
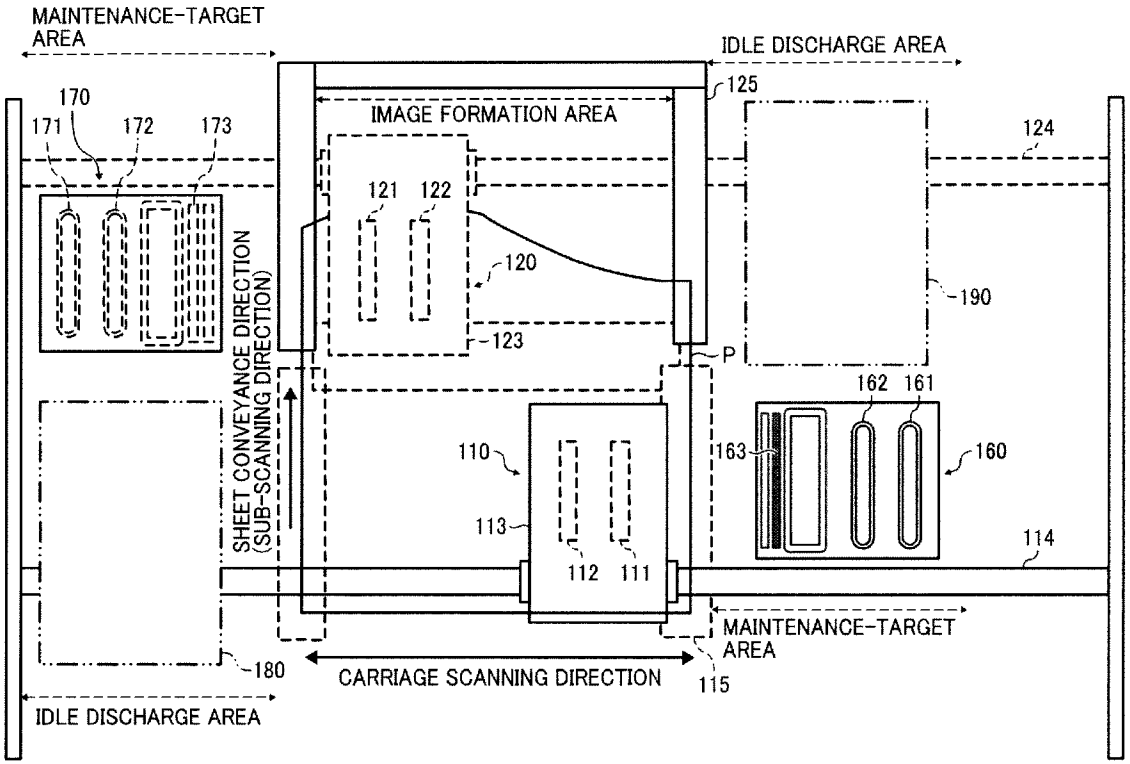
FIG. 2 is a plan view of the image forming apparatus of FIG. 1 illustrating a general configuration thereof.

An image forming apparatus according to a first embodiment of the present invention will now be described. FIG. 1 is a schematic view illustrating a general configuration of an image forming apparatus according to the first embodiment of the present invention and FIG. 2 is a plan view of the same.

The image forming apparatus 100 according to the first embodiment includes two offset print heads 110 and 120. The print head 110 discharges ink droplets downward and the print head 120 discharges ink droplets upward. The image forming apparatus 100 conveys a sheet of paper P (or simply a sheet P) being a recording medium and forms images on both sides of the sheet P as the sheet P is being conveyed.

The image forming apparatus 100 further includes, in addition to the print heads 110 and 120, a sheet feed unit 130 on which the sheet P is stacked; a sheet discharge tray 140 onto which the sheet P, on which images are formed, is discharged; and a conveyance path 150 through which the sheet P is conveyed from the sheet feed unit 130 to the sheet discharge tray 140 via the print heads 110 and 120. The conveyance path 150 is defined by multiple conveyance rollers 151 to 158.

When the sheet P is conveyed from the sheet feed unit 130 through the conveyance path 150, the print head 110 first forms images on a first or upper side of the sheet P, the print head 120 forms images on a second or lower side of the sheet P, and the sheet P is discharged to the sheet discharge tray 140.

The print head 110 includes rods 114, a carriage 113 movable along the rods 114 in a main scanning direction, and ink nozzle heads 111 and 112 to discharge ink droplets downward. Similarly, the print head 120 includes rods 124, a carriage 123 to be conveyed along the rods 124 in a main scanning direction, and ink nozzle heads 121 and 122 to discharge ink droplets upward.

As illustrated in FIG. 2, each of the print heads 110 and 120 is driven by a driver, not shown, along each of the rods 114 and 124, and is driven to be positioned at either a printing area, a maintenance area, or an idle discharge area. Printing is performed in the printing area, capping to prevent the print head from drying out and wiping away the ink are performed in the maintenance area, and the idle discharge is performed in the idle discharge area. Conveyance ribs 115 and 125 to guide the sheet P are disposed opposite the print heads 110 and 120 in the printing area.

In the printing operation, each of the print heads 110 and 120 is reciprocally driven along each of the rods 114 and 124 in a carriage scanning direction (that is, in the main scanning direction) in the printing area and discharges ink droplets based on image signals. By contrast, the sheet P is driven in a sheet conveyance direction (that is, in a sub scanning direction) through the conveyance path 150. Through such operations of the print heads 110 and 120 in the main scanning direction and of the sheet P in the sub scanning direction, images are formed on both sides of the sheet P.

In the image forming apparatus 100 according to the first embodiment, the ink nozzle heads 111 and 121 discharge three colors (yellow, magenta, and cyan) of ink, and the ink nozzle heads 112 and 122 discharge black ink. The ink nozzle head can be disposed for each color independently.

As illustrated in FIG. 2, the image forming apparatus 100 includes maintenance units 160 and 170 for each of the print heads 110 and 120. The maintenance units 160 and 170 each include cap members 161, 162, 171, and 172 to cover the ink nozzle heads 111, 112, 121, and 122, respectively. The maintenance units 160 and 170 each further include blade members 163 and 173 to wipe off the ink from the surface of the ink nozzle heads 111, 112, 121, and 122, respectively. The maintenance units 160 and 170 each are disposed in a maintenance area outside the image forming area for the sheet P.

The image forming apparatus 100 according to the first embodiment includes, in its respective idle discharge areas, ink receivers 180 and 190, respectively, to receive the idle-discharge ink. Each of the ink receivers 180 and 190 and maintenance units 160 and 170 is disposed in such a way as to sandwich the printing area.

Figure 3A:
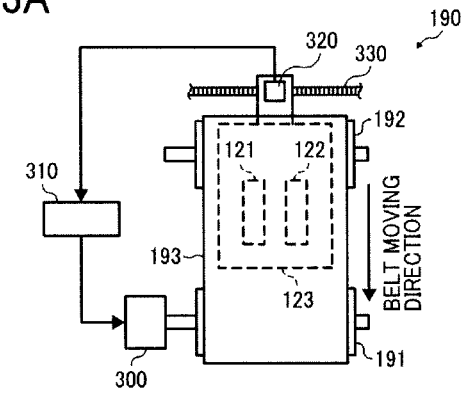
Figure 3B:
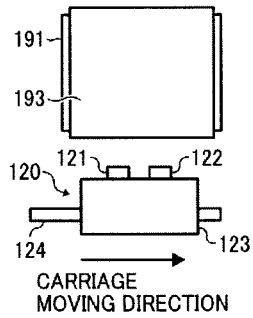
Figure 3C:
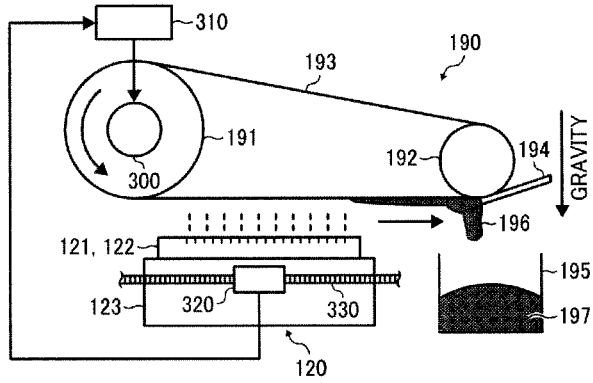

Next, a description will be given of the ink receiver 190. FIGS. 3A-3C each show a general configuration of a print head and an ink receiver, in which FIG. 3A shows a plan view of the print head and the ink receiver, FIG. 3B a side view thereof, and FIG. 3C a front view of the same.

The ink receiver 190 includes a drive roller 191 configured to be driven by a driver unit including a driver 310 and a motor 300, a driven roller 192 driven by the rotation of the drive roller 191, and an ink receiving member 193 formed of an endless belt member wound around the drive roller 191 and the driven roller 192. The ink receiver 190 further includes a cleaning blade 194 configured to scrape off ink 196 deposited on the ink receiving member 193 and an idle discharge ink tank 195 to collect ink 197 scraped off and falling from the ink receiving member 193. In the first embodiment, the ink receiving member driver unit is formed of the drive roller 191, the driven roller 192, and the driver unit. The cleaning blade 194 includes an elastic plate member and scrapes off the ink 196 by contacting the surface of the ink receiving member 193. A sensor 320 disposed at the carriage 123 is configured to read a scale of a linear encoder 330 to detect a position of the carriage 123. The driver 310 drives the motor 300 based on the information obtained by the sensor 320 and drives to rotate the ink receiving member 193.

The ink receiving member 193 is driven to circulate by the drive roller 191 and the driven roller 192, and the ink idly-discharged from the ink nozzle heads 121 and 122 is deposited on the slack part of the ink receiving member 193 between the rollers 191 and 192. The thus-deposited ink 196 is scraped off by the cleaning blade 194 and falls into the idle discharge ink tank 195.

Figure 4:
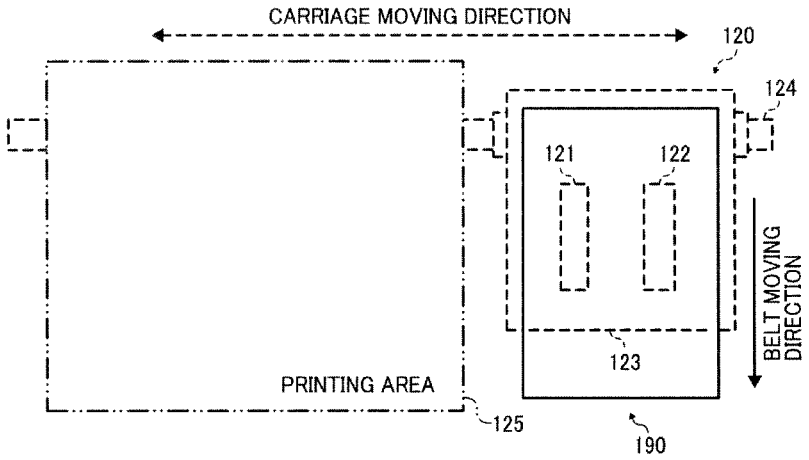
FIG. 4 is a plan view illustrating an operation of the print head of FIG. 1.

In the first embodiment, the drive roller 191 and the driven roller 192 are disposed along a direction perpendicular to the scanning direction of the carriage 123 and the ink receiving member 193 is driven to circulate along a direction perpendicular to the scanning direction of the carriage 123 as illustrated in FIG. 4. Herein, a distance between the slack part of the ink receiving member 193 and the ink nozzle heads 121 and 122 is set to be small so that the discharged ink does not disperse as a mist. In addition, the ink receiving member 193 is rotated during the idle discharge from the ink nozzle heads 121 and 122.

Normally, the distance from the nozzle surface of the nozzle head to the ink receiving surface that receives the ink droplets (i.e., the ink discharge distance) is several tens of millimeters. However, part of the ink droplets discharged by the ink print head becomes floating mist before arriving at the receiving surface of the ink droplets and contaminates surrounding areas.

It has been confirmed experimentally less mist is generated as the distance between the nozzle and the ink receiving surface becomes smaller. That is, experiments were performed at room temperature and humidity by setting a number or amount of ink droplets for idle discharge as approximately 6 to 10 pl per droplet and 50,000 droplets per nozzle and approximately 30 pl per droplet and 120 droplets per nozzle. The results of the experiments showed that there is no mist when the distance between the nozzle and the ink receiving surface is less than 5 mm. It also became clear that when the idle discharge is performed while the carriage (or the nozzle head) and the ink receiving member are not moving, the ink droplets to be deposited on the unit area of the ink receiving member become large and fall by their own weight, thereby contaminating the nozzle head.

In the first embodiment, however, because the idle discharge is performed while the ink nozzle heads 121 and 122 and the ink receiving member 193 are both being operated, the ink droplet to be deposited on the unit area of the ink receiving member 193 becomes small, and the deposited ink 196 remains on the ink receiving member 193 and does not fall downward.

Subsequently, as the ink receiving member 193 moves downstream, the ink 196 remaining on the ink receiving member 193 is scraped off by the cleaning blade 194, thereby ensuring collection of the idle-discharge ink droplets.

According to the first embodiment, the ink receiving member 193 is sufficiently closely disposed to the ink nozzle heads 121 and 122 so as not to generate mist to contaminate the ink nozzle heads 121 and 122. Further, the ink receiving member 193 is rotated during the idle discharge. Therefore, the amount of ink deposited per unit area of the ink receiving member 193 can be reduced and the contamination of the print head due to generation of the mist and the fallen ink droplets can be prevented.

Second Embodiment

Figure 5A:
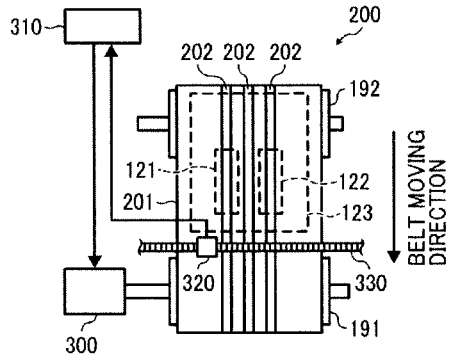
Figure 5B:
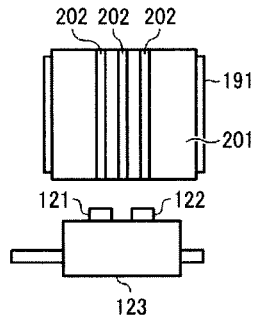
Figure 5C:
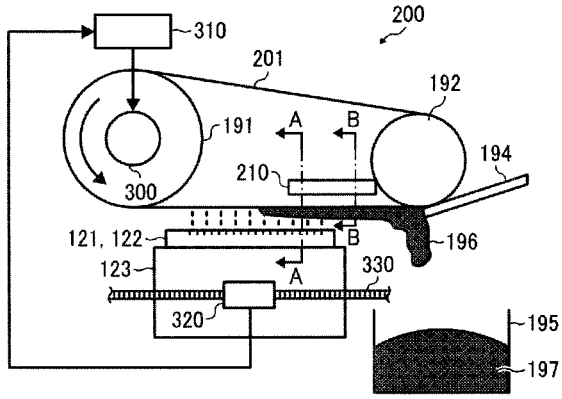
Figure 6:
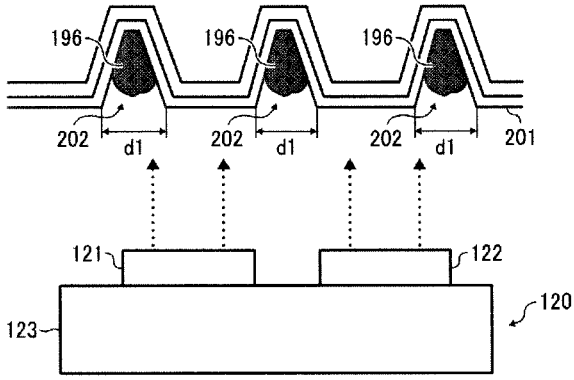
FIG. 6 is a cross-sectional view of an ink receiving member taken along a line A-A in FIG. 5C.
Figure 7:
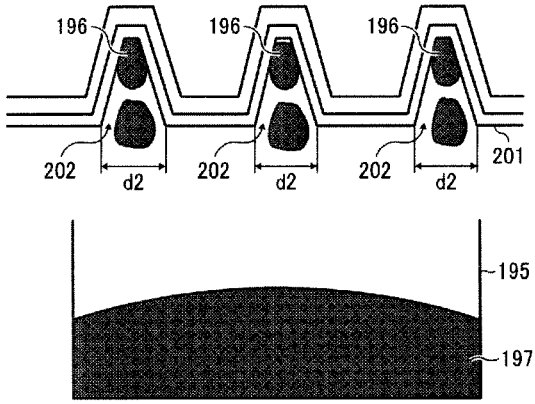
FIG. 7 is a cross-sectional view of the ink receiving member taken along a line B-B in FIG. 5C.
Figure 8:
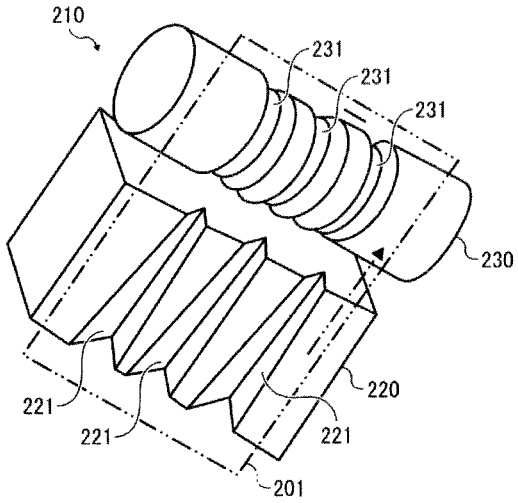
FIG. 8 is an oblique view illustrating an example of a groove change device for the print head in FIG. 5.

FIGS. 5A-5C each show a general configuration of a print head and an ink receiver according to a second embodiment, in which FIG. 5A shows a plan view of the print head and the ink receiver, FIG. 5B a side view thereof, and FIG. 5C a front view of the same. FIG. 6 is a cross-sectional view of the ink receiving member taken along a line A-A in FIG. 5C. FIG. 7 is a cross-sectional view of the ink receiving member taken along a line B-B in FIG. 5C. FIG. 8 shows an oblique view illustrating a groove-width changing unit of the print head.

An ink receiver 200 of the print head according to the second embodiment includes an ink receiving member 201 and grooves 202 formed in the ink receiving member 201. Each of the grooves 202 has a trapezoidal shape in cross section and holds the ink 196 therewithin with surface tension. The ink receiver 200 further includes a groove-width changing unit 210. The groove-width changing unit 210 is disposed above and downstream of a slack side of the ink receiving member 201 and configured to reduce the width (see a width d1 of FIG. 6) of the ink receiving member 201 to a width d2 in FIG. 7 as the ink receiving member 201 is conveyed downstream. As a result, the ink 196 held in the grooves 202 is squeezed out and scraped off by the cleaning blade 194, and falls into the idle discharge ink tank 195.

As illustrated in FIG. 8, the groove-width changing unit 210 includes a plate 220 and a roller 230. The plate 220 includes tapered guide grooves 221, each having a gradually narrowing width toward downstream. The roller 230 includes tapered guide grooves 231 having a gradually narrowing width toward the center. The guide grooves 231 of the ink receiving member 201 are squeezed by the guide grooves 221 and 231 of the plate 220 and the roller 230 from both sides, reducing the width from d1 to d2. As a width changing unit, either the plate 220 or the roller 230 may be used and any other mechanism that serves the purpose may be used.

Third Embodiment

Figure 9:
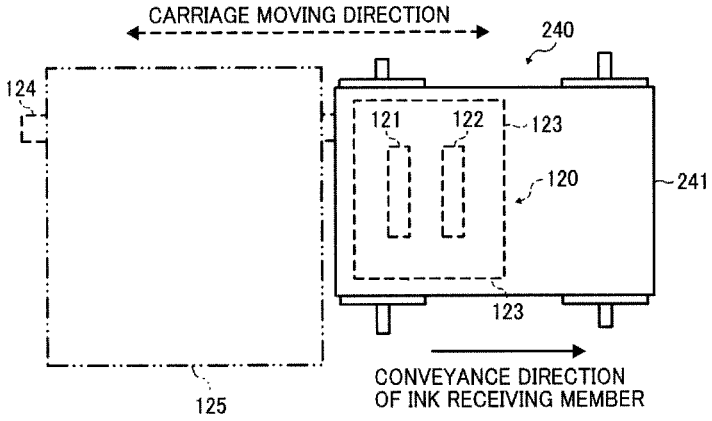
FIG. 9 is a plan view illustrating a general configuration of a print head according to a third embodiment of the present invention.

Next, a description will be given of a print head and an ink receiver according to a third embodiment of the present invention. FIG. 9 is a plan view illustrating a general configuration of the print head and the ink receiver according to the third embodiment of the present invention. An ink receiver 240 in the image forming apparatus according to the third embodiment includes an ink receiving member 241 driven to circulate in a same direction as that of the moving direction of the carriage 123. In the image forming apparatus according to the third embodiment, the print head 120 performs idle discharge of ink droplets onto the ink receiving member 241 while being moved by the carriage 123. The discharged ink deposits on the ink receiving member 241, moves rightward in the figure, and is scraped off by a cleaning member (not shown) and falls.

The image forming apparatus according to the third embodiment prevents the contamination of the print head due to generation of the mist and the fallen ink droplets caused by idle discharge similarly to the case of the image forming apparatus according to the first embodiment.

Fourth Embodiment

Figure 10:
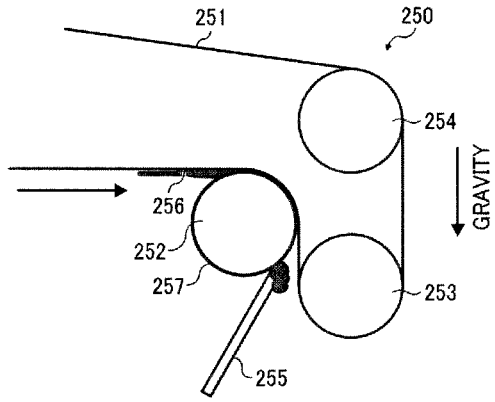
FIG. 10 is a side view illustrating a general configuration of an ink receiving member for a print head according to a fourth embodiment of the present invention.

Next, a description will be given of a print head according to a fourth embodiment of the present invention. FIG. 10 is a side view illustrating a general configuration of an ink receiver for the print head according to a fourth embodiment of the present invention. In the print head of the image forming apparatus according to the fourth embodiment, a surface of an ink receiving member 251 of an ink receiver 250 is water-repellant. In addition, three rollers 252, 253, and 254 are disposed downstream of the ink receiving member 251 toward a position of a cleaning blade 255 and the ink receiving member 251 is guided to form a downwardly curved portion. Further, a surface of the roller 252 is covered with a hydrophilic material 257 and the cleaning blade 255 is disposed in contact with the surface of the roller 252. In the fourth embodiment, both the roller 252 and the cleaning blade 255 serve as cleaning members.

According to the fourth embodiment, an ink 256 deposited on the ink receiving member 251 having water-shedding quality moves to the hydrophilic material 257 on the surface of the roller 252 and is removed by the cleaning blade 255. Therefore, the ink 256 deposited on the surface of the ink receiving member 251 can be removed effectively.

Fifth Embodiment

Figure 11:
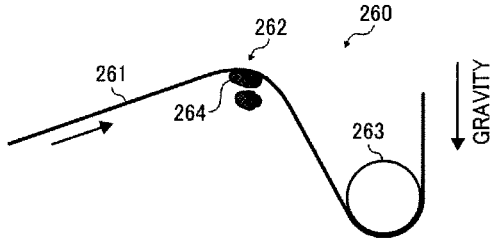
FIG. 11 is a side view illustrating a general configuration of an ink receiving member for a print head according to a fifth embodiment of the present invention.
Figure 12:
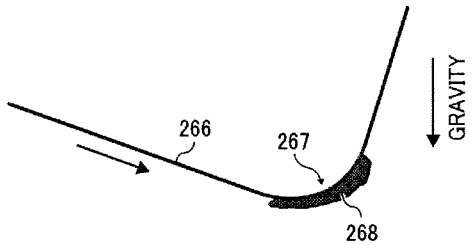
FIG. 12 is a side view illustrating a general configuration of a comparative example of an ink receiving member for a print head.
Figure 13:
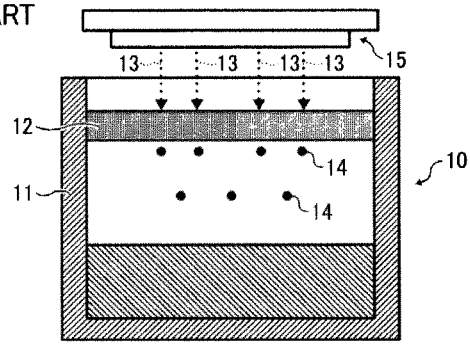
FIG. 13 BACKGROUND ART
FIG. 13 is a cross-sectional view illustrating an example of a conventional ink tank for idle discharge.
Figure 14:
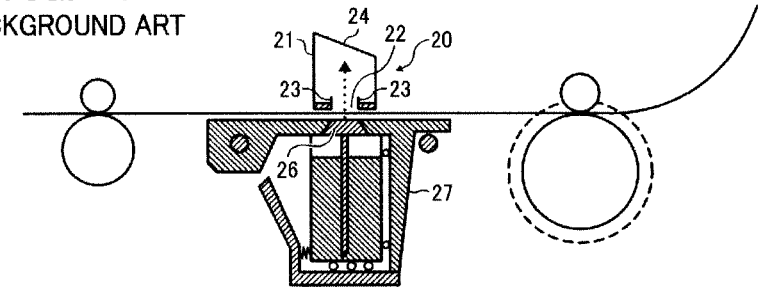
FIG. 14 BACKGROUND ART
FIG. 14 is a cross-sectional view illustrating another example of a conventional ink tank for idle discharge.
Figure 15:
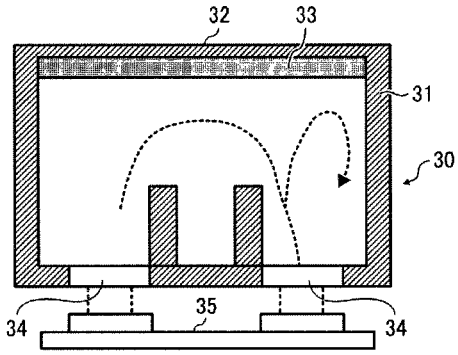
FIG. 15 BACKGROUND ART
FIG. 15 is a cross-sectional view illustrating an example of a conventional idle discharge ink tank capable of preventing generation of the mist.

FIG. 11 is a side view illustrating a general configuration of an ink receiver for the print head according to a fifth embodiment of the present invention. FIG. 12 is a side view of a comparative example. In the image forming apparatus according to the fifth embodiment, an upward curved portion 262 is formed downstream of an ink receiving member 261 of an ink receiver 260. Guide rollers are provided at both lateral ends of the ink receiving member 261 so that the curved portion 262 can be disposed upwardly. Reference numeral 263 denotes a driven roller of the ink receiving member 261.

As illustrated in FIG. 11 showing the ink receiver 260, ink 264 concentrates around the top of the curved portion 262 of the ink receiving member 261 due to surface tension and a contact area of the ink 264 with the ink receiving member 261 is small. Therefore, the ink 264 tends to fall under its own weight.

By contrast, when a downward curved portion 267 is formed on an ink receiving member 266 as illustrated in FIG. 12, deposited ink 268 expands over a surface of the curved portion 267 due to surface tension and does not fall easily.

In the above first to fifth embodiments, a print head including nozzles and configured to discharge ink droplets from the nozzles upward has been described. It is to be noted, however, that the embodiments of the present invention are not limited to a strictly vertical discharge direction alone, and alternatively may be applied to a case in which the direction in which the nozzles discharge ink droplets is obliquely upward. For example, although FIG. 1 shows that the nozzles are disposed horizontally, alternatively the nozzles may be disposed at an angle to a horizontal plane and the discharged direction of the ink droplets may be inclined from a vertical direction.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a print head, including nozzle heads, configured to discharge ink droplets upward and movable between an image forming area in which images are formed on a recording medium and an idle discharge area in which idle discharge of the ink droplets is performed to clean the nozzles;

an endless belt ink receiving member, disposed above the print head in the idle discharge area in which the print head performs idle discharge and configured to hold the idly-discharged ink;

an ink receiving member driver operatively connected to the ink receiving member to circularly drive the ink receiving member; and a cleaner disposed downstream of the idle discharge area in the direction of rotation of the ink receiving member and configured to remove the ink from the ink receiving member, wherein when the print head is disposed in the idle discharge area, a distance between the ink receiving member and the nozzle heads is less than 5 mm, and a controller configured to control the apparatus such that the ink receiving member and the nozzle heads which are configured to discharge the ink droplets upward towards the ink receiving member move relative to each other during the idle discharge of the ink droplets.

2. The image forming apparatus as claimed in claim 1, wherein the ink receiving member driver is configured to circularly drive the ink receiving member as the nozzle heads perform idle discharge.

3. The image forming apparatus as claimed in claim 1, further comprising a movable carriage on which the print head including the nozzle heads is mounted, wherein the nozzle heads perform idle discharge while being moved by the carriage in a main scanning direction.

4. The image forming apparatus as claimed in claim 1, wherein the cleaner includes a material having hydrophilic property.

5. The image forming apparatus as claimed in claim 1, wherein the ink receiving member includes grooves to hold the idly-discharged ink.

6. The image forming apparatus as claimed in claim 4, further comprising a groove-width changing unit configured to squeeze the grooves from both lateral sides thereof to temporarily reduce a width of the grooves of the ink receiving member gradually from the idle discharge position toward downstream.

7. The image forming apparatus as claimed in claim 6, wherein the groove-width changing unit is disposed above and downstream of the ink receiving member and comprises:

a plate including tapered guide grooves, each having a gradually narrowing width toward downstream; and a roller including tapered guide grooves having a gradually narrowing width toward the center.

8. The image forming apparatus as claimed in claim 1, wherein the ink receiving member has a downwardly curved portion at a position at which the cleaner is disposed.

9. The image forming apparatus as claimed in claim 1, wherein the ink receiving member is a belt member, and a lower side of the belt member comprises an ink receiving face to receive ink droplets discharged upward from the nozzle head toward the belt member and a cleaned face from which the cleaner removed the ink.

* * * * *